US007032811B1

(12) United States Patent
Paulic et al.

(10) Patent No.: US 7,032,811 B1
(45) Date of Patent: Apr. 25, 2006

(54) ROTATABLE MAILBOX WITH FLEXIBLE SUPPORT

(76) Inventors: Kenneth Paulic, 38 L. Laurel Dr., Scranton, PA (US) 18505; Dimitry Atrkhimovich, 38 L. Laurel Dr., Scranton, PA (US) 18505

( * ) Notice: Subject to any disclaimer, the term of this patent is extended or adjusted under 35 U.S.C. 154(b) by 0 days.

(21) Appl. No.: 11/036,947

(22) Filed: Jan. 14, 2005

Related U.S. Application Data

(60) Provisional application No. 60/537,185, filed on Jan. 16, 2004.

(51) Int. Cl.
*A47G 29/12* (2006.01)

(52) U.S. Cl. ..... 232/39; 248/131; 248/145; 248/156; 248/622

(58) Field of Classification Search ..... 232/39, 232/17; 248/145, 131, 156, 622, 415, 417, 248/418, 349.1; D99/32; 211/78
See application file for complete search history.

(56) References Cited

U.S. PATENT DOCUMENTS 3,407,997 A * 10/1968 Wood et al. ..... 232/39
3,827,626 A * 8/1974 Daigle ..... 232/17
3,899,150 A 8/1975 Racquet
4,508,259 A * 4/1985 Hicks ..... 232/17
4,667,918 A * 5/1987 Page ..... 248/418
4,792,088 A 12/1988 Bonnell
5,029,783 A 7/1991 Alvarez
5,042,716 A * 8/1991 Robbins ..... 232/39
5,065,975 A * 11/1991 Giles ..... 248/545
5,167,364 A * 12/1992 Wenning ..... 232/39
5,207,377 A * 5/1993 Brecht ..... 232/17
5,458,286 A * 10/1995 Paschal ..... 232/39
5,524,853 A * 6/1996 Varlaro ..... 248/145
5,699,989 A * 12/1997 Guthrie ..... 248/219.2

* cited by examiner

*Primary Examiner*—William L. Miller
(74) *Attorney, Agent, or Firm*—Goldstein Law Offices PC.

(57) ABSTRACT

A mailbox assembly having a rotatable mailbox attached to a flexible support for securing said assembly within the ground. The support includes a rod having a top end and a bottom end. The support also includes a bottom support plate positioned on the ground surface for stabilizing the mailbox. A mounted stake is attached to the bottom support plate for securing the support underneath the ground surface. A spring is attached between the bottom end of the rod and the bottom support plate, for allowing the support to bend from the spring in any direction upon impact. The mailbox, having an interior cavity, is rotatably secured to the support by a cylinder shaped support plate attached to a circular collar. The rod of the support is sized to fit though the circular collar of the cylinder shaped support plate and is fastened to the inside cavity of the mailbox by a ball. The ball is threaded to accept the rod and hold the cylinder shaped support plate in place against the bottom of the mailbox.

3 Claims, 3 Drawing Sheets

ROTATABLE MAILBOX WITH FLEXIBLE SUPPORT

CROSS REFERENCES AND RELATED SUBJECT MATTER

This application claims priority of of provisional patent application Ser. No. 60/537,185, filed in the United States Patent Office on Jan. 16, 2004.

BACKGROUND OF THE INVENTION

The invention relates to a mailbox, and more particularly, to a mailbox that is rotatably secured upon a flexible support.

People living in residential neighborhoods are accustomed to having a stationary mailbox in their front yard for collecting the mail being delivered. For some people the purchase of a mailbox is a "once in a lifetime" investment. In cold climates, however, mailboxes are constantly knocked over and damaged by snowplows, and therefore must be replaced yearly. Unfortunately, mailboxes are often covered by snowfall, making them impossible targets for snowplows to avoid. Many people living in these regions are forced to purchase new mailboxes every year because their old mailbox did not withstand the impact of the snowplows during the winter season.

U.S. Pat. No. 4,792,088 to Bonnell discloses a mailbox supported by a ground engaging post having a spring stem for absorbing shock such as impact from a vehicle. U.S. Pat. No. 3,899,150 to Racquet discloses a self-righting mailbox support having a tubular vertical element with an incorporated spring assembly. U.S. Pat. No. 5,029,783 to Alvarez discloses a flexible mailbox stand comprised of two sections joined by a spring assembly.

While these units may be suitable for the particular purpose employed, or for general use, they would not be as suitable for the purposes of the present invention as disclosed hereafter.

SUMMARY OF THE INVENTION

It is an object of the invention to produce a mailbox assembly having a sturdy mailbox and support that is resilient and able to rebound from lateral shock. Accordingly, the invention is a mailbox attached to a support having a flexible spring for providing resilience and a mounting stake for securing the support into the ground.

It is another object of the invention to provide a mailbox assembly having a rotatable mailbox that can withstand the impact of a vehicle or snowplow without being detached from the support. Accordingly, the invention has a cylinder shaped support plate that attaches the mailbox to the support and allows the mailbox to rotate independently around the axis of the support, thereby preventing damage to the mailbox.

It is another object of the invention to provide a mailbox assembly that remains stable within the ground after being struck. Accordingly, the invention has a mounted stake connected to a bottom support plate attached to a spring and positioned upon a ground surface. When the mailbox is struck, the spring bends to absorb the impact while the mounted stake holds the bottom support plate stable upon the ground surface.

The invention is mailbox assembly having a rotatable mailbox attached to a flexible support for securing said assembly within the ground. The support includes a rod having a top end and a bottom end. The support also includes a bottom support plate positioned on the ground surface for stabilizing the mailbox. A mounted stake is attached to the bottom support plate for securing the support underneath the ground surface. A spring is attached between the bottom end of the rod and the bottom support plate, for allowing the support to bend from the spring in any direction upon impact. The mailbox, having an interior cavity, is rotatably secured to the support by a cylinder shaped support plate attached to a circular collar. The rod of the support is sized to fit though the circular collar of the cylinder shaped support plate and is fastened to the inside cavity of the mailbox by a ball. The ball is threaded to accept the rod and hold the cylinder shaped support plate in place against the bottom of the mailbox.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
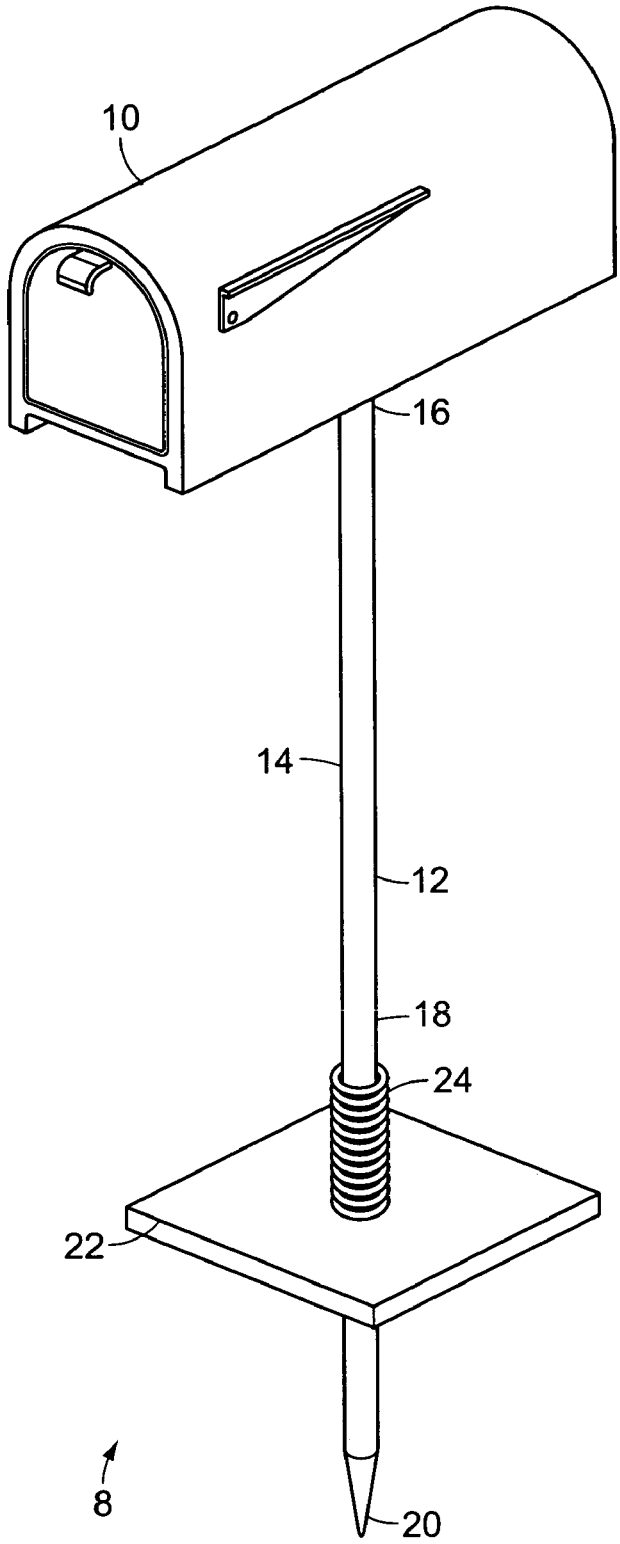
FIG. 1 is a diagrammatic perspective view of the present invention having a mailbox and a support that includes a rod attached to a bottom support plate with a spring.

FIG. 1 illustrates a mailbox assembly 8, including a mailbox 10 attached to a support 12 for allowing a user to secure the mailbox 10 in an upright position in a ground surface. The support includes a rod 14, preferably steel, having a top end 16 and a bottom end 18. The top end 16 is attached securely through the mailbox 10. The bottom end 18 is attached to a spring 24 which is perpendicularly attached to a bottom support plate 22. A mounted stake 20 extends downwardly from the support plate 22 for driving the support device 12 into the ground. The bottom support plate 22 is used to help mount the support 12 into the ground, and to provide lateral support and stability to the mailbox 10, thereby preventing the mailbox 10 from toppling over. The spring 24 is bendable which gives the rod 14 and the attached mailbox 10 the flexibility to move when struck, thereby preventing damage to the mailbox 10.

Figure 2:
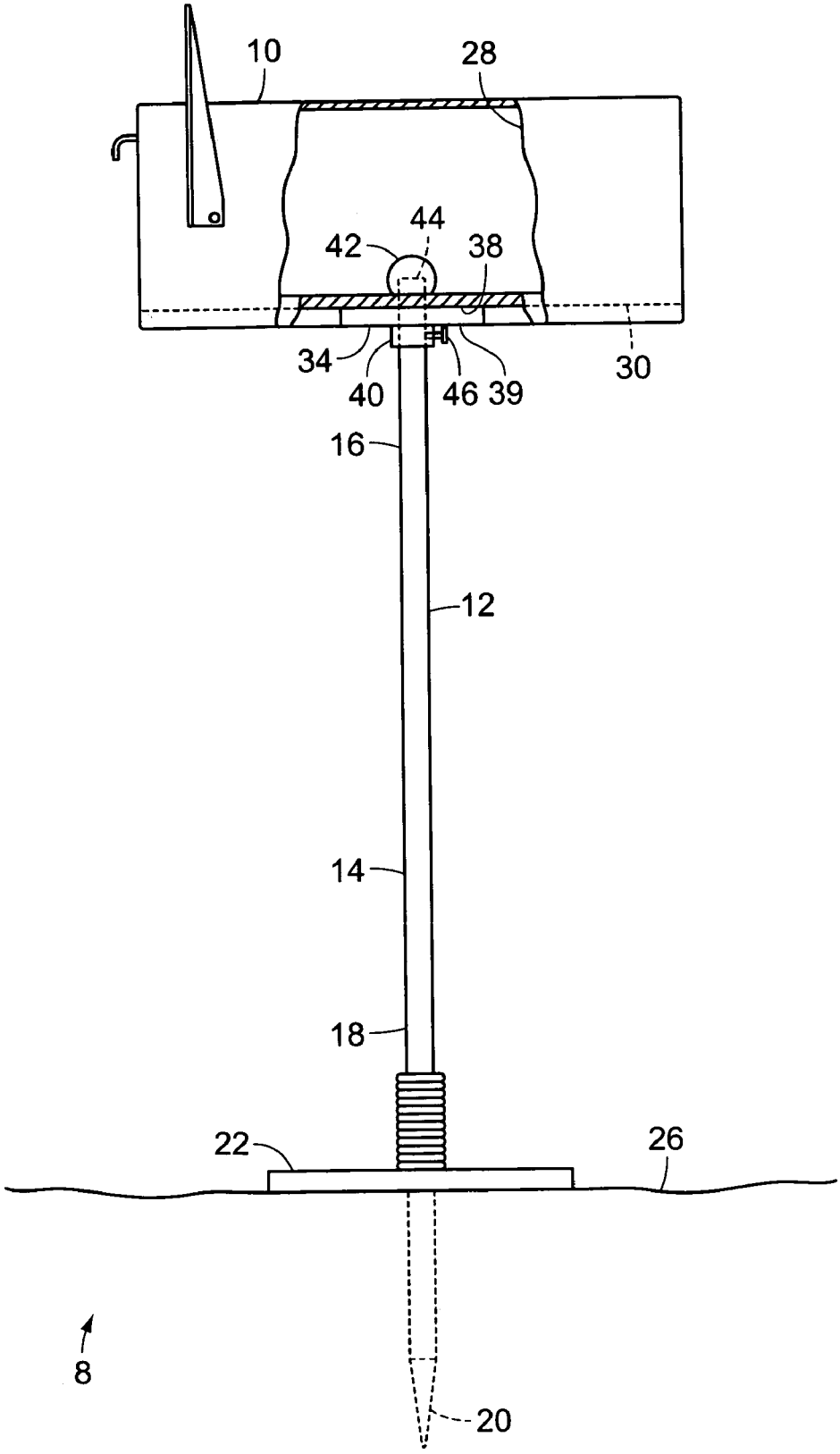
FIG. 2 is a side elevational view of the mailbox and the support device of the present invention mounted in the ground, with parts broken away from the mailbox illustrating attachment of the mailbox to the support.

FIG. 2 illustrates the mailbox 10 and the support 12 secured underneath a ground surface 26 by the mounted stake 20. The mounted stake 20 is driven below the ground surface 26, until the bottom support plate 22 is positioned upon the ground surface 26, thereby stabilizing the mailbox assembly 8.

FIG. 2 further illustrates the mailbox assembly 8, including the mailbox 10 having a bottom 30, which defines an interior cavity 28 for holding mail, and a means for fastening the support 12 to the mailbox 10. The bottom 30 of the mailbox includes a first circular cutout, slightly larger in diameter than the rod 14. A cylinder shaped support plate 34 has a bore approximately equal in diameter to the rod 14, for securing the rod 14 to the mailbox 10. The cylinder shaped support plate 34, has a top edge 38 and a bottom edge 39. The top edge 38 is positioned against the bottom 30 of the mailbox around the first circular cutout. A circular collar 40 attaches to the bottom edge 39 of said support plate 34 around the bore. The circular collar 40 has a set screw 46 for securing the cylinder shaped support plate 34 to the rod 14 and in position against the bottom 30 of the mailbox 10. The top end 16 of the rod 14 is sized to fit through the circular collar 40, through the bore of the cylinder shaped support plate 34, and into the interior cavity 28 of the mailbox 10. The cylinder shaped support plate 34 and circular collar 40 are adapted to allow the mailbox 10 to independently rotate around the top end 16 of the rod 14, thereby preventing the mailbox 10 from being damaged upon impact from a vehicle.

The top end 16 of the rod 14 includes a plurality of exterior threads. A ball 42 that has an interior cavity 44 and a plurality of internal threads accepts the external threads of the rod 14, thereby securing the mailbox 10 to the support 12. The exterior threads of the rod 14 are securely interlocked within the interior threads of the ball 42, which is preferably metal. The ball 42, when fastened tightly around the rod 14 secures the cylinder shaped support plate 34 to the bottom 30 of the mailbox 10. The set screw 46 fastens the circular collar 38 securely to the rod 14 thereby preventing said rod 14 from moving horizontally, and preventing the cylinder shaped support plate 34 from sliding downwardly along said rod 14. It should be clear from viewing the position of the support plate 34 with respect to the bottom 30 in FIG. 2, as well as from FIG. 1, that the mailbox 10 has a channel that is defined by lateral sides of the mailbox that extend lower than the bottom 30. The support plate 34 is thereby partially concealed within the channel by the lateral sides.

Figure 3:
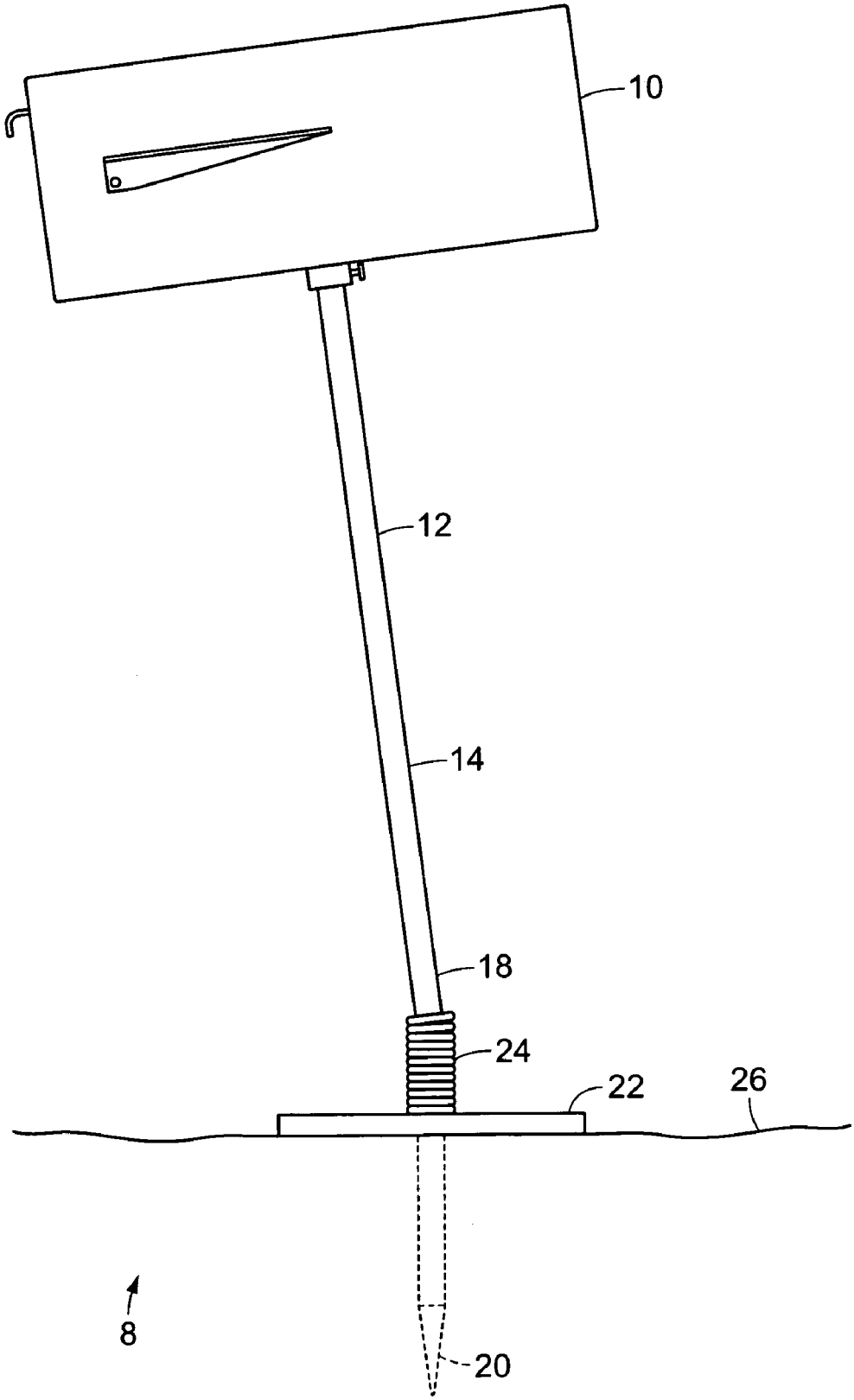
FIG. 3 is a side elevational view of the mailbox and the support of the present invention, showing the flexibility of the support in use while said support bends forward at its spring.

FIG. 3 illustrates the mailbox assembly 8 as the mailbox 10 and support 12 extend forward upon impact from the vehicle. The spring 24 is flexible enough to elongated and allow the support 12 and the mailbox 10 to extend forward from said spring 24. The spring 24 absorbs the momentum from the impact of the vehicle by uncoiling, while holding the bottom support plate 22 and the mounted stake 20 in position. As the spring 24 bends and uncoils to absorb the impact, the mounted stake 20 holds the bottom support plate 22 in a stable position on the ground surface 26. The spring 24 is resilient to any force that strikes the mailbox 10 or the support 12 and is bendable up to 90 degrees in any direction.

In conclusion, herein is presented a rotatable mailbox with flexible support for withstanding the impact of a vehicle. The invention is illustrated by example in the drawing figures, and throughout the written description. It should be understood that numerous variations are possible, while adhering to the inventive concept. Such variations are contemplated as being a part of the present invention.

What is claimed is:

1. A mailbox assembly, for mounting in a ground surface, comprising:

a mailbox having an interior cavity for holding mail and having a bottom surface having a first circular cutout; and a support including a rod having a top end and a bottom end, a support plate having a mounted stake extending downwardly for penetrating the ground surface, and a spring extending between the bottom end of the rod and the support plate, the top end of the rod extending through the first circular cutout for allowing the mailbox to rotate around the top end of the rod to prevent the mailbox from becoming damaged upon impact from a vehicle; and a cylindrical shaped support plate coaxially attached to a circular collar, the top end of the rod extending through the circular collar and support plate, the circular collar having a set screw for engaging and securing against the rod and positionally fixing the support plate and circular collar with respect to the rod, the support plate having a top edge that rests against the bottom surface of the mailbox.

2. The mailbox assembly as recited in claim 1, wherein the top end of the rod has external threads, and further comprising a ball having internal threads for securing the ball onto the top end of the rod within the interior cavity of the mailbox, the ball thereby securing the rod to the mailbox.

3. The mailbox assembly as recited in claim 2, wherein the bottom surface of the mailbox is within a channel defined by a pair of lateral sides that extend lower than the bottom surface for partially concealing the support plate within said channel.

* * * * *